United States Patent [19]

Morefield

[11] 4,234,001

[45] Nov. 18, 1980

[54] HAIR TREATMENT DEVICE

[76] Inventor: Joe Morefield, 400 Reynolds St., Springhill, La. 71075

[21] Appl. No.: 59,517

[22] Filed: Jul. 23, 1979

[51] Int. Cl.[3] ..... A45D 2/00

[52] U.S. Cl. ..... 132/40

[58] Field of Search ..... 132/40, 41 R, 42, 9

[56] References Cited

U.S. PATENT DOCUMENTS

| | | | |
|---|---|---|---|
| 2,430,766 | 11/1947 | Gregory | 132/40 |
| 2,473,957 | 6/1949 | King et al. | 132/41 R |
| 2,536,705 | 1/1951 | Teopilian | 132/40 |
| 2,769,449 | 11/1956 | Portell | 132/42 R |

*Primary Examiner*—G. E. McNeill

[57] ABSTRACT

A hair treatment device characterized by a round, partitioned rod having, in a preferred embodiment, a post on one end and a partition between the post and the opposite end, the post, partition and rod each having a plurality of staggered apertures for securing the device in place with pins. The rod may be provided with a single partition in another embodiment of the invention, and the partitioned design permits a length or tress of hair to be wound on the device and treated simultaneously with separate treating solutions and no comingling of the solutions. The device may also be provided with grooves traversing the partition and rod to accommodate the hair strands or tresses and effect more uniform curling.

10 Claims, 12 Drawing Figures

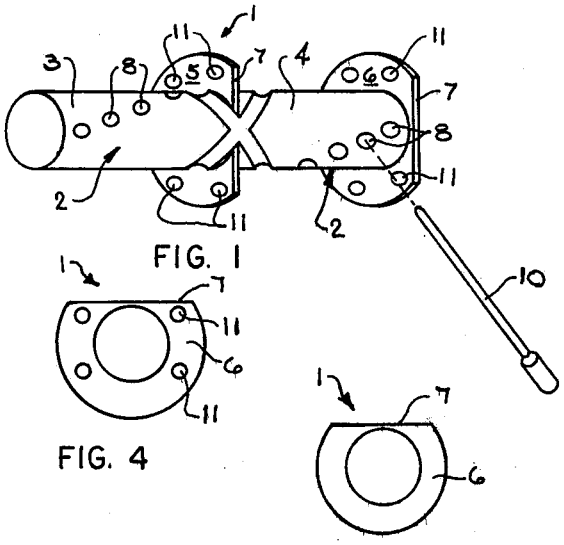
FIG. 1
FIG. 4
FIG. 10
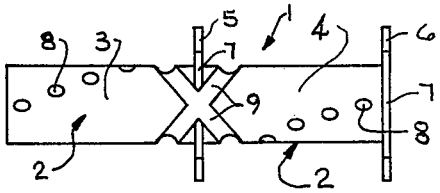
FIG. 2
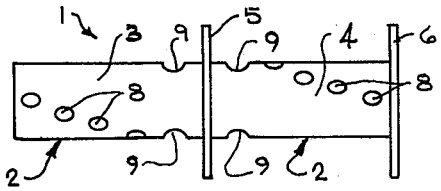
FIG. 3
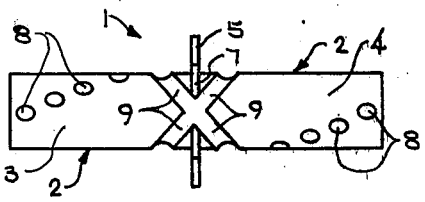
FIG. 5
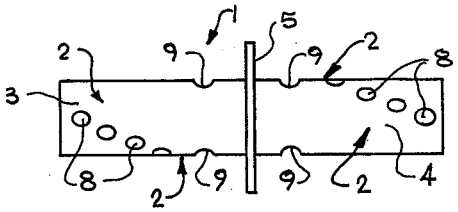
FIG. 6
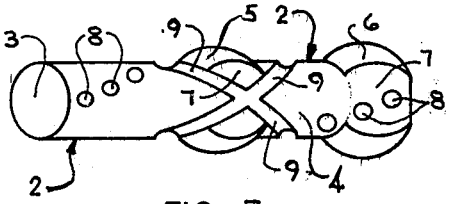
FIG. 7
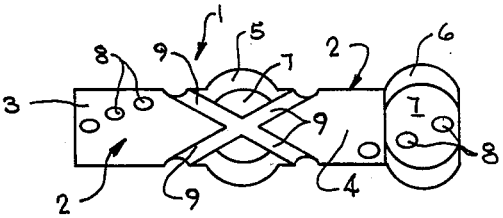
FIG. 8
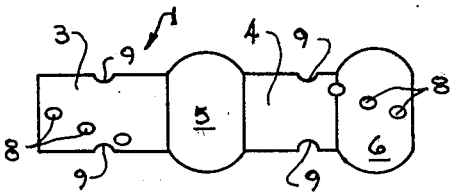
FIG. 9
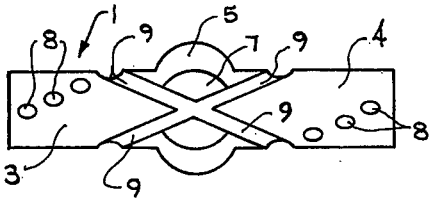
FIG. 11
FIG. 12
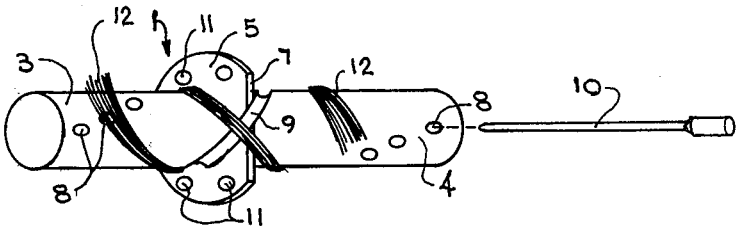

HAIR TREATMENT DEVICE

BACKGROUND OF THE INVENTION

1. Field of the Invention

This invention relates to hair treatment, and more particularly, to a hair treatment device for use primarily in separating and isolating individual tufts or tresses of hair and permitting selected segments of the tresses to be treated with different treating solutions. In one embodiment the hair treatment device includes a rod having a partition intermediate the ends thereof and a post on one end, with staggered apertures in the post, rod and partition for securing the device in place, the partition operating to prevent comingling of treating solutions placed on the separate segments of the wound tresses. Grooves may be provided in the rod in the area of the partition in order to provide a uniform length of curl and wave pattern in the hair as the hair strands or tresses are wound on the rod and secured in place. In another embodiment of the invention the rod may be provided with a single partition and with the grooves to provide more uniform curling of the strands.

2. Description of the Prior Art

Many devices for curling and treating hair are known in the prior art. Typical of such devices is the hair curling device disclosed in U.S. Pat. No. 3,105,503 to Albert Safianoff, which consists of a mandrel and a cooperating sleeve designed to hold a tress of hair in wound configuration on the mandrel. The device is designed to form curls in the hair as the individually wound tresses are caused to assume a curled configuration from winding on the mandrel. Another hair curling device is disclosed in U.S. Pat. No. 2,423,252 to O. R. Nemeth, which device is used for both dressing and drying hair. The Nemeth apparatus includes a hollow, cylindrical body fitted with spaced disks and holes provided in the body to permit air to be blown through the hollow interior of the body and out of the holes. Hair tresses are wound around the cylindrical body between the disks, treated as desired, and dried by application of air, for example, from a hairdryer. The tresses are then secured in place by elastic bands stretched from one end of the device to the other. Another hair curling device is disclosed by U.S. Pat. No. 2,867,223 to R. L. Anzalone, which includes a cylindrical spindle with a pair of arms pivotally mounted on the spindle and adapted to close on a hair tress or strands wound on the spindle. U.S. Pat. No. 2,536,705 to A. Teopilian illustrates a hair curler clamping bobbin having telescoping loop and an adjustable end plate.

There exists today a need in the hair treatment field for, and it is an object of this invention to provide, a hair treatment device which is characterized by at least one partition on a rod, which device is small, light in weight, easy to manipulate and anchor in the hair, capable of receiving strands, tufts or tresses of hair in isolated fashion for separate treatment and uniform curling, and which is comfortable, particularly while the user is sleeping or resting.

Another object of the invention is to provide a hair treatment device which is characterized by a grooved rod and at least one dividing partition, which rod is, in a preferred embodiment, hollow to reduce weight and is small in diameter to permit treatment of hair wound thereon very close to the scalp.

Yet another object of this invention is to provide a hair treatment and curling device primarily for use in professional shops which includes a round, partially partitioned, grooved curler rod with a post or enlargement having a flat area thereon on one end, which rod is, in a preferred embodiment, capable of receiving a single tress or tuft of hair wound thereon and separated by the partition for separate treatment of the tress segments.

Another object of the invention is to provide a new and improved hair treatment device which is shaped and grooved to receive a single hair tress or tuft, the length of which device is separated by a truncated partition to permit selective, separate treatment of the hair tress with no mixing of the treating solutions.

A still further object of the invention is to provide a new and improved hair curler and treatment device for professional use, which device is characterized by a grooved rod having at least one truncated partition and post mounted thereon, which partition and post are formed and shaped to conform to the shape of a user's head, which device can be quickly and easily secured in place by conventional pins inserted in staggered holes after a single tress or tuft of hair is wound thereon.

Another object of the invention is to provide a new and improved hair treatment device which includes a shaft or rod fitted with a pair of crossing grooves and a curved, truncated post on one end and a curved, truncated partition spaced from the post and located between the post and the opposite end of the device, with the truncated segments essentially parallel to each other, and a plurality of staggered, spaced apertures in the rod, post and partition to permit the device to be securely, yet comfortably, positioned in the hair with pins.

Yet another object of the invention is to provide an improved hair curling and treatment device which includes a round rod having an essentially semicircular shaped, truncated post on one end thereof and an essentially semicircular shaped, truncated partition spaced from the post and having the curved portion thereof extending from the rod in parallel relationship to the curved portion of the post, the truncated or flat segment of the post and partition being in essentially parallel relationship to each other, and the rod being further fitted with a pair of intersecting grooves for receiving the tuft or tress of hair and to effect uniform curling of the hair.

SUMMARY OF THE INVENTION

These and other objects of the invention are provided in a hair treatment device which includes a round curler rod having at least one truncated partition intermediate the ends thereof, and, in a preferred embodiment, a truncated post secured to one end. In a most preferred embodiment of the invention, a single, curved partition with a flat or truncated edge in essentially parallel relationship to the truncated post is provided, with spaced apertures in the rod, partition and post to accommodate pins for securing the device in place against the scalp. The post and partition are preferably curved in coextension from the curler rod, and a pair of intersecting grooves are formed in the rod diagonally across the truncated segment of the partition to facilitate uniform wave formation of a hair tress wound on the rod and in a selected one of the grooves.

BRIEF DESCRIPTION OF THE DRAWINGS

The invention will be better understood by reference to the accompanying drawing, wherein:

FIG. 1 of the drawing is a perspective view of a preferred embodiment of the hair treatment device of this invention;

FIG. 2 is a top elevation of the hair treatment device illustrated in FIG. 1;

FIG. 3 is a bottom elevation of the hair treatment device illustrated in FIG. 1;

FIG. 4 is a left end elevation of the hair treatment device illustrated in FIG. 1;

FIG. 5 is a top elevation of an alternative embodiment of the hair treatment device of this invention;

FIG. 6 is a bottom elevation of the hair treatment device illustrated in FIG. 5;

FIG. 7 is a perspective view of another embodiment of the hair treatment device of this invention;

FIG. 8 is a top elevation of the hair treatment device illustrated in FIG. 7;

FIG. 9 is a bottom elevation of the hair treatment device illustrated in FIGS. 7 and 8;

FIG. 10 is a right end elevation of the hair treatment device illustrated in FIG. 7;

FIG. 11 is a top elevation of still another preferred embodiment of the invention; and FIG. 12 is a perspective view of the hair treatment device illustrated in FIGS. 5 and 6.

DESCRIPTION OF THE PREFERRED EMBODIMENTS

Referring now to FIGS. 1-4 of the drawing, the hair treatment device of this invention is generally represented by reference numeral 1. The device includes a round, preferably hollow rod, generally illustrated by reference numeral 2, and further characterized by end segment 3 and post segment 4, defined by a flat partition 5, the latter of which is preferably generally truncated and semicircular in shape, and is provided with spaced logitudinal apertures 11. Truncated segment 7 of partition 5 is cut such that it is coextensive with the surface of rod 2 near the center of the segment. Post 6, also preferably truncated and semicircular in configuration and provided with spaced apertures 8, is joined to one end of rod 2, or may be molded integrally with rod 2, as desired. Truncated segment 7 of post 6 is also cut so as to be coextensive with the surface of rod 2 near the center of the segment and is generally parallel to the truncated segment 7 of partition 5.

It will be appreciated that partition 5 and post 6 project from rod 2 on all sides thereof except at truncated segment 7, and partition 5 serves to divide rod 2 into two distinct segments, end segment 3 and post segment 4. Like post 6, partition 5 is preferably formed integrally with rod 2, and in a preferred embodiment of the invention both members project concentrically from the surface of rod 2 along a substantial portion of the surface of the rod and are co-extensive with rod 2 at one point at the center of truncated segment 7. As illustrated, apertures 8 are drilled through rod 2 in continuous, staggered relationship to permit one or more pins 10 to be inserted through rod 2 from top to bottom and from side to side, respectively, of hair treatment device 1. Similarly, and referring now to FIGS. 1 and 12 of the drawing, logitudinal apertures 11 in post 6 and partition 5 are aligned in spaced relationship to permit a hair tuft or tress 12 to be secured in place by a pin or pins 10. In a most preferred embodiment of the invention grooves 9 are provided in the surface of rod 2, extending from end segment 3 and diagonally crossing that portion of rod 2 which coincides with truncated segment 7, and into post segment 4. As illustrated in FIG. 12, a hair tuft or tress 12 can be initially wound on end segment 3 and positioned in the appropriate one of grooves 9, to terminate on post segment 4. Since the distance around rod 2 at the diagonal across the area on rod 2 where truncated segment 7 and rod 2 coincide is greater than the circumference of rod 2, grooves 9 serve to equalize the curl in hair tress 12. Accordingly, in a preferred embodiment of the invention grooves 9 are cut sufficiently deep in rod 2 to insure that the length of the diagonal wrap of hair tress 12 in grooves 9 and around rod 2 is substantially equal to the ungrooved circumference of rod 2. This provision insures that each curl in hair tress 12 will be substantially equal in magnitude, and provides a uniform wave pattern in the hair.

Referring now to FIGS. 5, 6 and 12 of the drawing, in another preferred embodiment of the invention rod 2 is divided into end segment 3 and post segment 4 by a flat, circular and truncated partition 5, having a truncated segment 7, as in the case of the device illustrated in FIGS. 1-4, but without a post 6. End segment 3 and post segment 4 are essentially equal in length and truncated segment 7 coincides with the surface of rod 2 at the center of the segment, as illustrated.

Referring to FIGS. 7-9 of the drawing, in yet another preferred embodiment of the invention rod 2 is provided with a partition 5 and a post 6 formed in spaced relationship on rod 2 as enlarged nodules on the rod. As in the case of the device illustrated in FIGS. 1-4, a truncated segment 7 is provided on both partition 5 and post 6, which segment coincides with a flattened area on rod 2 at the point of truncation. Grooves 9 are provided as described above in order to standardize the magnitude of curl in each hair tress wound on the rod 2, and ensure a uniform wave pattern in the hair.

Referring again to FIG. 12 of the drawing, a hair tress 12 is illustrated in wound configuration on end segment 3 and post segment 4 of rod 2 in one of the grooves 9, and isolated by partition 5. If, for example, it is desired to treat only the new growth of hair nearest the scalp and not the end segment of the hair tuft, the hair tress 12 is first wound on post segment 4, the hair strands crossed to end segment 3 in one of grooves 9 at the flat edge of partition 5, and the end portion of hair tress 12 wound on end segment 3, leaving the area of hair tress 12 adjacent the scalp concurrently isolated on post segment 4 for treatment. Partition 5 prevents the treating solution from flowing from end segment 3 to post segment 4 when the flat edge of partition 5 is secured against the scalp by pins 9. A small portion of lambs wool can be used to hold the ends of the hair tress on end segment 13, if desired.

It will be appreciated that hair treatment device 1 of this invention can be easily and comfortably utilized to curl and treat adjacent tufts or tresses of hair in the manner outlined above because of the small physical size and light weight of the device and the design of truncated partition 5 and post 6. For example, under circumstances where it is desired to "frost" the end segment of a tress or tresses of hair and otherwise treat the adjacent segment, the end portion designated for "frosting" can be wound on the end segment 3 of rod 2 after the intermediate section is wound on post segment 4. When the entire area of hair to be treated is similarly wound and secured in place by using pins 10, each respective tress can be treated as desired with little or no interaction between treating solutions, due to the barrier provided by partition 5.

While rod 2 is preferably divided into two portions, end segment 3 and post segment 4, by a single partition 5, it will be appreciated that rod 2 can be provided with additional partitions of substantially any shape and multiple sets of grooves 9 to permit multiple tress segments of hair to be wound and isolated on rod 2, as desired. The number, shape, and size of such partitions is limited only by the practicality of easily winding multiple tufts or tresses of hair on a single rod in specified segments defined by a plurality of partitions 5.

The hair treatment device of this invention can be manufactured of substantially any suitable material, but is preferably formed of plastic, rubber or fiberglass materials which are impervious to commonly used hair treating solutions, according to the knowledge of those skilled in the art. Rod 2 is also preferably hollow to facilitate comfort due to reduced weight, and in a preferred embodiment, the partition or partitions 5 and post 6 are formed integrally with the rod 2. The device can be easily formed by injection molding or other well known production methods, depending upon the type of material chosen for manufacturing. While the device is generally designed for use by professional hair stylists, it will be appreciated that it may also be used by individuals in the home as well, according to the proficiency of the user. The device is characterized by flexibility in that it can be utilized to roll the hair tress segments from the tip of the segments in, or from the scalp out, as desired, and according to the proficiency of the user.

It will be further appreciated that the extent of treatment can be varied by using a hair treatment device in which the respective diameters of end segment 3 and post segment 4 are dissimilar. For example, a stronger "set" is achieved when the hair tresses are wound in tight coils on a roller of small diameter in comparison to tresses wound on a roller of larger diameter, assuming that a like concentration of treating solution is used in both cases. Generally, a rod 2 of small diameter is preferred in the instant invention in order to achieve a good "set" and to permit treatment of hair quite close to the scalp. Accordingly, the degree of "set" can be varied in applicant's invention by varying the size of both end segment 3 and post segment 4 of rod 2, as desired. However, when a "set" of maximum uniformity is desired to achieve a uniform wave pattern, a hair treatment device which is provided with grooves 9 may be used according to the description set forth above.

Having described my invention with the particularlity set forth above, what is claimed is:

1. A hair treatment device comprising a rod of selected length; at least one partition positioned intermediate the ends of said rod and projecting from said rod in essentially perpendicular relationship and having a first truncated segment intersecting a surface of said rod; a pair of grooves provided in said rod and extending in an arc from opposite sides of said rod on one side of said partition to opposite sides of said rod on the other side of said partition and intersecting at said first truncated segment; and a plurality of apertures in said rod and said partition for receiving pins to secure a curl or tress of hair in place.

2. The hair treatment device of claim 1 further comprising a post on one end of said rod spaced from said partition and projecting from said rod in essentially perpendicular relationship, said post having a second truncated segment intersecting a surface of said rod in essentially parallel relationship to said first truncated segment.

3. The hair treatment device of claim 1 wherein said plurality of apertures in said rod are staggered throughout the length of said rod to facilitate insertion of said pins in said apertures to secure said hair treatment device in place.

4. The hair treatment device of claim 2 wherein said at least one partition is a single partition, said post and said partition are flat and round, and said first truncated segment and said second truncated segment intersect said surface of said rod essentially at the center of said first truncated segment and said second truncated segment, respectively.

5. The hair treatment device of claim 2 wherein said post and said partition are enlarged nodules on said rod and said first truncated segment and said second truncated segment are flat areas on said nodules.

6. The hair treatment device of claim 1 wherein the distance around said rod following the path of said grooves is equal to the circumference of said rod.

7. The hair treatment device of claim 2 wherein:

(a) said at least one partition is a single partition, said post and said partition are flat and round, and said first truncated segment and said second truncated segment intersect said surface of said rod essentially at the center of said first truncated segment and said second truncated segment respectively; and (b) the distance around said rod following the path of said grooves is equal to the circumference of said rod.

8. The hair treatment device of claim 2 wherein:

(a) said post and said partition are enlarged nodules on said rod and said first truncated segment and said second truncated segment are flat areas on said nodules; and (b) the distance around said rod following the path of said grooves is equal to the circumference of said rod.

9. The hair treatment device of claim 2 wherein the segment of said rod between said partition and said post is smaller than the segment of said rod between said partition and the opposite end of said rod.

10. The hair treatment device of claim 2 wherein the segment of said rod between said partition and said post is larger than said segment of said rod between said partition and the opposite end of said rod.

* * * * *